US005747433A

United States Patent [19]

Luciani et al.

[11] Patent Number: 5,747,433

[45] Date of Patent: May 5, 1998

[54] OIL CONCENTRATES OF POLYMERS WITH IMPROVED VISCOSITY

[75] Inventors: Carmen V. Luciani, Wickliffe; Richard M. Lange, Euclid; Joseph G. Seebauer, Mentor, all of Ohio

[73] Assignee: The Lubrizol Corporation, Wickliffe, Ohio

[21] Appl. No.: 683,556

[22] Filed: Jul. 15, 1996

[51] Int. Cl.[6] ..... C10M 157/00

[52] U.S. Cl. ..... 508/479; 508/490; 508/591

[58] Field of Search ..... 508/591, 479, 508/490

[56] References Cited

U.S. PATENT DOCUMENTS

| | | | |
|---|---|---|---|
| 2,407,954 | 9/1946 | Fenske et al. | 252/52 |
| 2,602,048 | 7/1952 | Michaels et al. | 252/32.7 |
| 2,610,948 | 9/1952 | Morway et al. | 252/56 |
| 3,762,888 | 10/1973 | Kober et al. | 44/62 |
| 3,772,196 | 11/1973 | St. Clair et al. | 508/591 |
| 3,793,200 | 2/1974 | Billings | 508/591 |
| 4,162,985 | 7/1979 | Holubec | 508/591 |
| 4,406,803 | 9/1983 | Liston et al. | 252/52 |
| 4,524,007 | 6/1985 | Chibnik | 252/56 |
| 4,826,615 | 5/1989 | Rossi et al. | 252/56 |
| 4,891,145 | 1/1990 | Brod et al. | 252/52 |
| 4,970,011 | 11/1990 | Kuwamoto et al. | 252/56 |
| 4,990,274 | 2/1991 | Nalesnik | 252/52 |
| 5,026,496 | 6/1991 | Takigawa et al. | 252/52 |
| 5,278,252 | 1/1994 | Rhodes et al. | 508/591 |

FOREIGN PATENT DOCUMENTS

| | | | |
|---|---|---|---|
| 0330522 | 8/1989 | European Pat. Off. | C10M 161/00 |

*Primary Examiner*—Jacqueline V. Howard
*Attorney, Agent, or Firm*—David M. Shold

[57] ABSTRACT

A composition of about 2 to about 20 percent of a hydrogenated diene/vinyl aromatic block copolymer and a nonionic surface active agent, soluble in said oil, comprising at least one ester or ether group, in a medium of oil of lubricating viscosity, exhibits reduced viscosity compared with comparable compositions without the surface active agent.

24 Claims, No Drawings

OIL CONCENTRATES OF POLYMERS WITH IMPROVED VISCOSITY

BACKGROUND OF THE INVENTION

The present invention relates to a method for reducing the viscosity of certain solutions of polymers and to the resulting polymer solutions.

Lubricant compositions such as motor oils have been the subject of much research to improve their physical and chemical properties. For instance viscosity index ("VI") modifiers, also referred to as VI improvers, which are generally polymers, have been used for many years to provide oils with useful viscosity at both high and low operating temperatures.

Although there are a great number of polymeric species which have been employed as VI modifiers, one of the most important classes comprises hydrogenated styrene/diene block copolymers. This material is often supplied as a concentrate in an oil or other oleophilic medium, for later incorporation and dilution into a fully formulated product. Concentrates are convenient media for handling materials which must be added in small amounts, which exist in their neat form as a solid, or for which it is otherwise desirable to handle in a liquid form. The higher concentration of polymer in a concentrate, however, can lead to a different category of handling difficulties. Certain polymers, in particular the aforementioned hydrogenated styrene/diene block copolymer VI modifiers and chemically closely related equivalents, tend to provide mixtures of unacceptably high viscosity when they are present in a concentrate, in particular, at concentration levels above 2 or 3 percent by weight. It is believed that this increase in viscosity is attributable to attractive interactions between the blocks of aromatic monomers in adjacent polymer chains, leading to a labile form of crosslinking and network formation. By whatever mechanism, concentrates of hydrogenated styrene/diene block copolymers have heretofore been limited in their utility because of their high viscosities.

U.S. Pat. No. 5,026,496, Takigawa et al., Jun. 25, 1991, discloses a composition useful as a viscosity index improver, comprising (A) an olefinic copolymer, (B) a copolymer of an olefin with a (meth)acrylate, (C) a poly(meth)acrylate, and (D) a surfactant, which is poor solvent for components (A) and (B). The composition has a relatively low viscosity even at high polymer contents.

U.S. Pat. No. 4,406,803, Liston et al., Sep. 27, 1983, discloses lubricating oils containing oil soluble $C_{10}$–$C_{30}$ alkane 1,2-diols. The lubricant can also contain typical viscosity index improvers such as styrene diene copolymers.

U.S. Pat. No. 4,891,145, Brod et al., Jan. 2, 1990, discloses a lubricating oil containing a mixture of a lubricating oil pour depressant and a polyoxyalkylene ester, ether, ester/ether or mixture thereof. The pour depressant can be for example a vinyl acetate copolymer, a polyalkylacrylate, a polyalkylmethacrylate, or an esterified olefin/maleic anhydride copolymer.

U.S. Pat. No. 2,602,048, Michaels et al., Jul. 1, 1952, discloses lubricating oil additives. The addition of certain oxygenated organic compounds of the glycol ether type improves the compatibility of metalo-organic additives and highly polymeric additives, and corrects thereby the unacceptable turbidity of a lubricant using these two additives. The copolymeric materials useful as viscosity index improvers or pour depressors and contemplated in this reference include the dibasic acid ester-vinyl ester copolymers.

European publication 330 552, Aug. 30, 1989, discloses lubricating oil compositions comprising (A) a lubricating oil dispersant additive of (1) ashless dispersants and/or (2) polymeric viscosity index improver dispersants, and (B) a demulsifier additive comprising the reaction product of an alkylene oxide and an adduct obtained by reacting a bis-epoxide with a polyhydric alcohol.

SUMMARY OF THE INVENTION

The present invention provides a composition comprising:

(a) about 2 to about 20 percent by weight of the composition of a block copolymer comprising a vinyl aromatic comonomer moiety and second comonomer moiety;

(b) an oil of lubricating viscosity;

(c) a non-ionic surface active agent, soluble in said oil, comprising at least one ester or ether group, in an amount sufficient to reduce the viscosity of said composition of polymer in oil; wherein the total amount of polymer species in the composition, exclusive of the non-ionic surface active agent, is less than 30 percent by weight.

In another aspect, the present invention provides a process for reducing the viscosity of a composition comprising an oil of lubricating viscosity and about 2 to about 20 percent by weight of the composition of a hydrogenated diene/vinyl aromatic block copolymer, comprising the steps of:

(a) selecting a non-ionic surface active agent, soluble in oil, comprising at least one ester or ether group; and (b) combining the non-ionic surface active agent with the oil and the polymer, in an amount sufficient to reduce the viscosity of said composition of polymer in oil.

DETAILED DESCRIPTION OF THE INVENTION

One component (b) of the composition of the present invention is one or a mixture of oils of lubricating viscosity in which the block copolymer comprising a vinyl aromatic comonomer moiety and second comonomer moiety, component (a), described in greater detail below, is soluble but exhibits an unacceptably high viscosity when present in relatively concentrated solutions. Of particular interest and importance in the present invention are non-polar hydrocarbon oils, and particularly those which are predominantly aliphatic in character. Hydrocarbon oils include mineral lubricating oils of paraffinic, naphthenic, aromatic, or mixed types, and are preferably predominantly paraffinic (aliphatic) oils, with at most minor amounts of naphthenic (cycloaliphatic) or aromatic components. Oils containing a major amount of aromatic oil components are expected to exhibit the advantages of the present invention less clearly, since the aromatic content is expected to interact with the aromatic block portions of the dissolved block polymer to provide compatibility and minimize the inordinately large increase in viscosity, which the present invention alleviates.

The oil will preferably also be substantially free from heteroatoms which would impart significant polar character. Suitable oils can be solvent or acid treated mineral oils, and include oils derived from coal or shale. Hydrocarbon oils can be naturally-occurring or synthetic oils, the latter including polyalphaolefin oils, both hydrogenated and non-hydrogenated. Polyalphaolefin oils are oligomers of alpha olefins, and are commercially available as 3 to 8- cSt fluid from, for example, Chevron, Ethyl, or Mobil. Olefins themselves are well-known substances, which include ethylene and other olefins having 3 to 40, preferably 4 to 24, carbon atoms. Alpha-olefins are sometimes referred to as 1-olefins or terminal olefins, and include, for example propylene and 1-butene, 1 -pentene, 1-hexene, 1-heptene, 1-octene, 1-nonene, 1-decene, 1-tridecene, 1-tetradecene, 1-pentadecene, 1-hexadecene, 1-heptadecene, 1-octadecene, 1-nonadecene, 1-eicosene, 1-heneicosene, 1-docosene, and 1-tetracosene. Commercially available alpha-olefin fractions are also available, including the $C_{15-18}$ alpha-olefins, $C_{12-16}$ alpha-olefins, $C_{14-16}$ alpha-olefins, $C_{14-18}$ alpha olefins, $C_{16-18}$ alpha-olefins, $C_{16-20}$ alpha-olefins, $C_{18-24}$ alpha olefins, and $C_{22-28}$ alpha-olefins. Also included are unrefined, refined, and rerefined oils, including modified mineral oils made by hydrotreating and hydrocracking processes. Specific examples of a variety of oils of lubricating viscosity, many of which are suitable for the present invention, are described in U.S. Pat. No. 4,326,972. Preferred oils include mineral oil and poly-α-olefin oil.

The specific suitability of a given oil for the present invention can be determined by dissolving the polymeric component (a) of interest in the oil at a concentration of about 6 percent by weight. The presence of dissolved polymer will generally lead to at least a certain minimal increase in the viscosity of the composition, but in combinations for which the present invention is particularly applicable, the increase in viscosity will normally be at least about a factor of 5 to 10 or more higher than normally expected for a non-associative polymer of similar molecular weight and polydispersity. Otherwise expressed, the Brookfield viscosity of a solution of an associative polymer will typically be 5 to 10 or more times greater when measured (or extrapolated) to shear rates of near 0 $sec^{-1}$, compared with the viscosity when measured at 100 $sec^{-1}$.

The terms "dissolved" and "soluble" are use throughout this specification and in the appended claims to refer to the distribution of the substances in question in the oil or other phase to which they are added. While the present invention is not dependent on any particular theory, it should be understood that in some instances the substances may dissolve to form true solutions while in other instances, micelle dispersions or microemulsions are formed which visibly appear to be true solutions. Whether a solution, micelle dispersion, or microemulsion is formed may be dependent on the particular substance to be dissolved and the particular medium to which it is added. In any event, the terms "dissolved" and the like are used throughout this specification and in the appended claims to refer to solutions, micelle dispersions, microemulsions, and the like.

The lubricating oil in the invention is present in a concentrate-forming amount and will normally comprise the major amount of the composition. Thus it will normally be at least 50% or 60% by weight of the composition, preferably 70 to 96%, and more preferably 84 to 93%. The oil can comprise the balance of the composition after accounting for components (a) and (c) described below and any optional ingredients.

Another component (a) of the composition of the present invention is a block copolymer comprising a vinyl aromatic comonomer moiety and second comonomer moiety. Illustrative of such materials are hydrogenated diene/vinyl aromatic block copolymers, which typically can function as a viscosity improving agent. These copolymers are prepared from, first, a vinyl aromatic monomer. The aromatic portion of this monomer can comprise a single aromatic ring or a fused or multiple aromatic ring. Examples of fused or multiple aromatic ring materials include vinyl substituted naphthalenes, acenaphthenes, anthracenes, phenanthrenes, pyrenes, tetracenes, benzanthracenes, biphenyls, and the like. The aromatic comonomer may also contain one or more heteroatoms in the aromatic ring, provided that the comonomer substantially retains its aromatic properties and does not otherwise interfere with the properties of the polymer. Such heteroaromatic materials include vinyl-substituted thiophene, 2-vinylpyridine, 4-vinylpyridines, N-vinylcarbazole, N-vinyloxazole, and substituted analogues thereof. More commonly the monomers are styrenes. Examples of styrenes include styrene, alpha-methyl styrene, ortho-methyl styrene, meta-methyl styrene, para-methyl styrene, and para-tertiary butyl styrene. The vinyl group in the vinyl aromatic monomer is commonly an unsubstituted vinyl (e.g., $CH_2{=}CH{-}$) group, or an equivalent group of such a nature that it provides adequate means for incorporation of the aromatic comonomer into the polymer chain as a "block" (or segment) of homopolymer, having a number of consecutive uniform repeating units, which imparts a high degree of aromatic content to the block. The preferred vinyl aromatic monomer is styrene.

The second monomeric component of this polymer can be any monomer capable of polymerizing with the vinyl aromatic comonomer. Examples of such monomers include dienes such as 1,3-butadiene, isoprene, chloroprene, acrylate esters, methacrylate esters, and alkylene oxides. All of these monomers can be copolymerized with vinyl aromatic monomers to yield block polymers, usually under anionic conditions. Low temperatures are usually required with these monomers, particularly when acrylate or methacrylate esters are employed.

Conditions for block copolymerization of acrylate and methacrylate esters onto mono-and i-anionic polystyrene polymers are described in the Encyclopedia of Polymer Science and Engineering (1987 ed.) Vol. 2. Several techniques are employed in making vinyl aromatic block polymers, the most common of which involve the intermediacy of a "living" polystyrene segment having the anionic moiety at one or both ends of the molecule. The living anionic sites can then be used to graft the next type of block by addition or displacement reaction on the second type of monomer chosen. For example, conjugate addition of the carbanion end to an acrylate ester can result in a new carbanion adjacent to a stabilizing carbonyl group. Subsequent consecutive additions to acrylate ester monomer results in the growth of a polyacrylate block attached to the original polystyrene segment. If the starting polystyrene segment has a living anion moiety at both ends, conjugate addition can result in a triblock polymer wherein the end segments are polyacrylate blocks.

Other types of monomers can undergo anionic polymerizations to form block copolymer by ring-opening reactions initiated by anionic polystyrene intermediates. These include epoxides, episulfides, anhydrides, siloxanes, lactones, lactams, and the like. Nucleophilic attack on epoxide monomers by anionic polystyrenes, for example, can produce, in a polyoxyalkylene block, a polyether terminating an alkoxide group. Similar ring-opening polymerization of lactones can be used to introduce a polyester segment, and siloxanes can produce blocks of polysiloxane.

Particularly preferred comonomers for anionic copolymerization with the vinyl aromatic monomers are dienes. Dienes contain two double bonds, commonly located in conjugation in a 1,3 relationship. Olefins containing more than two double bonds, sometimes referred to as polyenes, are also considered to be included within the definition of "dienes" as used herein. Examples of such diene monomers include 1,3-butadiene and hydrocarbyl substituted butadienes such as isoprene and 2,3-dimethylbutadiene. These and numerous other monomers are well known and widely used as components of elastomers as well as modifying monomers for other polymers. Preferably the diene is a conjugated diene which contains from 4 to 6 carbon atoms. Examples of conjugated dienes include 1,3 butadiene and hydrocarbyl-substituted butadienes such as piperylene, 2,3-dimethyl-1,3-butadiene, chloroprene, and isoprene, with isoprene and butadiene being particularly preferred. Mixtures of such conjugated dienes are also useful.

The vinyl aromatic monomer content of the present copolymers is typically in the range of about 20% to about 70% by weight, preferably about 40% to about 60% by weight. The remaining comonomer content of these copolymers is typically in the range of about 30% to about 80% by weight, preferably about 40% to about 60% by weight. If the remaining comonomer is an aliphatic conjugated diene, third and other monomers can also be present, normally in relatively small amounts (e.g., about 5 to about 20 percent), including such materials as $C_{2-10}$ olefin oxides, ε-caprolactone, and δ-butyrolactone. Since the vinyl aromatic-containing di-and tri-block copolymers are made by sequential addition and polymerization of the individual monomer components, the polymerization mixture will contain a large preponderance of only one of the monomers at any particular stage in the overall polymerization process. In comparison, in the manufacture of a random block copolymer, more than one monomer may be present at any particular stage of the polymerization.

Styrene-diene copolymers, as a preferred example, can be prepared by methods well known in the art. The styrene/diene block polymers of this invention are usually made by anionic polymerization, using a variety of techniques, and altering reaction conditions to produce the most desirable features in the resulting polymer. In an anionic polymerization, the initiator can be either an organometallic material such as an alkyl lithium, or the anion formed by electron transfer from a Group IA metal to an aromatic material such as naphthalene. A preferred organometallic material is an alkyl lithium such as sec-butyl lithium; the polymerization is initiated by addition of the butyl anion to either the diene monomer or to the styrene.

When an alkyl lithium initiator is used, a homopolymer of one monomer, e.g., styrene, can be selectively prepared, with each polymer molecule having an anionic terminus, and lithium gegenion:

$$Bu^{-}\,{}^{+}Li + mA(monomer) \rightarrow Bu\text{—}(\text{—}A\text{—})_m^{-}\,{}^{+}Li$$

The resulting polymers will, when monomer is completely depleted, all be of similar molecular weight and composition, i.e., "monodisperse" (the ratio of weight average molecular weight to number average molecular weight is very nearly 1.0) At this point, addition of 1,3-butadiene or isoprene to the homopolystyrene-lithium "living" polymer produces a second segment which grows from the anion site to produce a living di-block polymer having an anionic terminus, with lithium gegenion.

$$Bu\text{—}(\text{—}A\text{—})_m^{-}\,{}^{+}Li + nB(monomer) \rightarrow Bu\text{—}(\text{—}A\text{—})_m\text{—}(\text{—}B\text{—})_n^{-}\,{}^{+}Li$$

Introduction of additional styrene can produce a new poly A-block-poly B-block-poly A, or A—B—A triblock polymer; higher orders of block polymers can be made by consecutive stepwise additions of different monomers in different sequences.

Alternatively, a living diblock polymer can be coupled by exposure to an agent such as a dialkyl-dichlorosilane. When the carbanionic "heads" of two A—B diblock living polymers are coupled using such an agent, precipitation of LiCl occurs to give an A—B—A triblock polymer of somewhat different structure than that obtained by the sequential monomer addition method described above, wherein the size of the central B block is double that of the B block in the starting living (anionic) diblock intermediate.

Block copolymers made by consecutive addition of styrene to give a relatively large homopolymer segment (A), followed by a diene to give a relatively large homopolymer segment (B), are referred to as poly-A-block-poly-B copolymers, or A—B diblock polymers.

In another variation, where metal naphthalide is used to initiate polymerization, single electron-transfer to monomer (A) generates a radical-anion which can dimerize to yield a di-anionic nucleophile which in turn initiates polymerization in two directions simultaneously. Thus, $$\bullet Naph^{-}Li^{+} + A(monomer) \rightarrow Naph + \bullet A^{-}Li^{+}$$

$$2\bullet A^{-}Li^{+} \rightarrow (dianion)$$

$${}^{+}Li^{-}A\text{—}A^{-}Li^{+} + mA(monomer) \rightarrow {}^{+}Li^{-}(\text{—}A\text{—})_{m+2}^{-}Li^{+}$$

Exposure to a second monomer (B) results in formation of a polyB-block-polyA- block-polyB, or a B—A—B triblock polymeric dianion, which may continue to interact with additional anionically-polymerizable monomers of the same, or different chemical type, in the formation of higher order block polymers. Ordinary block copolymers are generally considered to have up to about 5 such blocks.

The solvent employed in anionic polymerization can determine the nature of the copolymer that is formed. Non-polar paraffinic solvents such as hexane or heptane inhibit charge separation at the growing anion, diminish the basicity of the active organolithium head, and slow the rates of initiation, thus emphasizing the differences in relative rate of polymerization between various monomers.

Usually, one monomer or another in a mixture will polymerize faster, leading to a segment that is richer in that monomer, contaminated by occasional incorporation of the other monomer. In some cases, this can be used beneficially to build a type of polymer referred to as a "random block polymer", or "tapered block polymer. When a mixture of two different monomers is anionically polymerized in a non-polar paraffinic solvent, one will initiate selectively, and usually polymerize to produce a relatively short segment of homopolymer. Incorporation of the second monomer is inevitable, and this produces a short segment of different structure. Incorporation of the first monomer type then produces another short segment of that homopolymer, and the process continues, to give a more or less "random" alternating distribution of relatively short segments of homopolymers, of different lengths. Random block polymers are generally considered to be those comprising more than 5 such blocks. At some point, one monomer will become depleted, favoring incorporation of the other, leading to ever longer blocks of homopolymer, in a "tapered block copolymer."

An alternative way of preparing random or tapered block copolymers involves initiation of styrene, and interrupting with periodic, or step, additions of diene monomer. The additions are programmed according to the relative reactivity ratios and rate constants of the styrene and particular diene monomer.

"Promoters" are electron-rich molecules that facilitate anionic initiation and polymerization rates while lessening the relative differences in rates between various monomers. Promoters also influence the way in which diene monomers are incorporated into the block polymer, favoring 1,2-polymerization of dienes over the normal 1,4-cis- addition, which can affect the solubility properties of the resulting polymer. Promoters include tetrahydrofuran, tetrahydropyran, linear and crown ethers, N,N-dimethylformamide, tetramethyl ethylenediamine, and other non-protic agents that have non-bonding electron pairs available for coordination.

Hydrogenation of the unsaturated block polymers initially obtained produces polymers that are more oxidatively and thermally stable. Reduction is typically carried out as part of the polymerization process, using finely divided, or supported, nickel catalyst. Other transition metals may also be used to effect the transformation. Hydrogenation is normally carried out to reduce approximately 94–96% of the olefinic unsaturation of the initial polymer. In general, it is preferred that these copolymers, for reasons of oxidative stability, contain no more than about 5% and more preferably no more than about 0.5% residual olefinic unsaturation on the basis of the total amount of olefinic double bonds present in the polymer prior to hydrogenation. Such unsaturation can be measured by a number of means well known to those of skill in the art, such as infrared or nuclear magnetic resonance spectroscopy. Most preferably, these copolymers contain no discernible unsaturation, as determined by the aforementioned-mentioned analytical techniques.

The polymers, and in particular styrene-diene copolymers, are, in a preferred embodiment, block copolymers in which a portion of the blocks are composed of homopolymer or homo-oligomer segments of the vinyl aromatic monomer and another portion of the blocks are composed of homopolymer or homo-oligomer segments of the diene monomer, as described above. The polymers generally possess a number average molecular weight of at least greater than 50,000, preferably at least 100,000, more preferably at least 150,000, and most preferably at least 200,000. Generally, the polymers should not exceed a number average molecular weight of 500,000, preferably 400,000, and more preferably 300,000. The number average molecular weight for such polymers can be determined by several known techniques. A convenient method for such determination is by size exclusion chromatography (also known as gel permeation chromatography (GPC)) which additionally provides molecular weight distribution information, see W. W. Yau, J. J. Kirkland and D. D. Bly, "Modern Size Exclusion Liquid Chromatography", John Wiley and Sons, New York, 1979. The polydispersity (the $M_w/M_n$ ratio) of certain particularly suitable block polymers is typically between 1.0 and 1.2, Among the monomers which can be used to prepare the polymers of the present inventions are 1,3-butadiene, 1,2-pentadiene, 1,3-pentadiene, isoprene, 1,5-hexadiene, and 2-chloro-1,3 butadiene, and aromatic olefins such as styrene, a-methyl styrene, ortho-methyl styrene, meta-methyl styrene, para-methyl styrene, and para-t-butyl styrene (and mixtures thereof) in the presence of the catalyst system, described above. Other comonomers can be included in the mixture and in the polymer, which do not substantially change the character of the resulting polymer. The comonomer content can be controlled through the selection of the catalyst component and by controlling the partial pressure of the various monomers, as described in greater detail above.

Suitable styrene/isoprene hydrogenated regular diblock copolymers are available commercially from Shell Chemical Co. under the trade names Shellvis 40 ($M_w$ ca. 200,000) and Shellvis 50 ($M_w$ ca. 150,000). Suitable styrene/1,3-butadiene hydrogenated random block copolymers are available from BASF under the trade name Glissoviscal ($M_w$ ca. 160,000–220,000).

The amount of the hydrogenated diene/vinyl aromatic block copolymer in the composition is that which provides a solution or mixture with a viscosity which is decreased by addition of the third component (c). Particularly suitable concentrations, particularly when the oil is mineral oil, are 2 to 20 percent by weight. At concentrations much below this level the polymer is soluble in the oil without exhibiting unduly increased viscosity due to association, so that the advantages of the present invention are not fully realized. At concentrations much above this level the composition can exhibit increased viscosity and certain difficulties in handling, even in the presence of component (c) of the present invention. A preferred concentration range of component (b) is 4 to 18 percent by weight; more preferably 6 to 12 percent.

Many types of block polymers show intermolecular associative behavior in which segments of like homopolymer agglomerate. In this sense, the block polymers demonstrate a kind of surface-active nature, forming micelles, similar to those formed by classical surfactants.

Intermolecular association of oil-soluble block copolymers used as viscosity modifiers for lubricants, such as those described above, can pose significant problems in terms of handleability of concentrates. The polymer content of a polymeric viscosity improver concentrate ranges typically from about 5–40% by weight, in a mineral oil, synthetic hydrocarbon, or ester diluent. With non-associative polymers, such as olefin copolymers, ethylene/propylene/diene (EPDM) polymers, butyl polymers, or polymethacrylates, concentrates can be prepared at relatively high cocerntrations without experiencing unduly high bulk viscosities. The styrene-diene block copolymers, however, are highly associative through the mutual affinity of their polystyrene segments, so that the amount of polymer that can be dissolved before the concentrate viscosity become too great to pour, is relatively low. The association problem is exacerbated by the use of non-polar mineral oils or synthetic hydrocarbon diluents that are themselves relatively poor solvents for the polystyrene segments in the block copolymers. In these diluents, the degree of association is relatively high. The effective thickening power of the copolymer aggregates can even render the concentrate a gel, and the concentrate becomes unpourable at temperatures as high as 100° C.

Polystyrene-block-polyisoprene hydrogenated diblock copolymers having two relatively large segments tend to associate to a much greater degree than do random block polymers of similar composition and molecular weight. Typically, diblock copolymer concentrates which remain pourable at 100° C. can be prepared only up to about 6% by weight, or 8% by weight for random block copolymers. The present invention provides for disruption of such association by addition of nonionic surfactant, described below, to the polymer concentrate. Concentrate kinematic viscosity at 100° C. can be reduced dramatically, typically by an order of magnitude. Kinematic viscosity is the viscosity coefficient of a material divided by its density: $\nu=\eta/\rho$, and is determined by conventional methods well known to those skilled in the art.

The third component (c) of the present invention is a non-ionic surface active agent, soluble in the oil (b), which contains at least one ester or ether group. Nonionic surfactants are those which, while possessing a polar and a non-polar portion, contain substantially no functionality which is present as either an anion or a cation when in use. Suitable materials are readily available from a variety of commercial sources.

The non-ionic surfactant is preferably selected from the group consisting of: (i) alkylene diols and polyoxyalkylene diols; (ii) alkyl and aryl mono- and bis-ethers of polyoxyalkylene diols, where the oxyalkylene group has at least two carbon atoms and the alkyl or aryl groups have at least nine carbon atoms; (iii) partial or full alkanoate esters of polyoxyalkylene diols, where the repeating oxyalkylene group has at least two carbon atoms and the alkanoate group has at least nine carbon atoms; (iv) mixed ether/ester-terminated polyoxyalkylene polymers, as in the preceding groups; and (v) partial alkanoate esters of hydrocarbylene polyols, where the hydrocarbylene group has at least three carbon atoms and the alkanoate group has at least nine carbon atoms.

Examples of type (i) surfactants include polypropylene glycol (molecular weight 100–800), for instance, Pluracol™ P-410 or P-1010 from BASF Wyandotte; polyoxyalkylene diols made from mixtures of $C_2$–$C_{18}$ alkylene oxides, for instance, UCON™ 75H series of ethylene oxide/propylene oxide polymers (75% EtO:25% PrO by weight; starting with a central diol); triblock polymers of ethylene oxide and propylene oxide (or higher alkylene oxide) units, of the general formula HO—[—Pr—O—]$_a$—[Et—O—]$_b$—[—Pr—O—]$_c$—OH such as the series of materials from BASF designated as Pluronic™ 12R3 (HLB 2–7), 17R2, 17R4, and 25R4 (HLB of each 7–12, differing in molecular weight), or of the general formula HO—[—Et—O—]$_a$—[Pr—O—]$_b$—[—Et—O—]$_c$—OH designated as Pluronic™ L-31 (HLB 1–7), L-43 (HLB 7–12), L-62 (HLB 1–7), and L-63, L-101, and L-103 (HLB 7–12).

Examples of type (ii) surfactants include materials prepared by the polyalkoxylation of fatty alcohols or alkyl phenols, including $C_{12-14}$ linear alkyl mono-ether of triethylene glycol (Alfonic™ 1412–40 from Vista Chemical Co.), $C_{12-14}$ linear alkyl mono-ether of heptaethylene glycol (Alfonic™ 1412–60), $C_{12-13}$ linear and branched mixed monoethers of polyethylene glycols (made from the Neodol™ 23 series of alcohols and 2–10 moles of ethylene oxide, from Shell Chemical Co.), $C_{12-15}$ linear and branched mixed monoethers of polyethylene glycol (made from the Neodol™ 25 series of alcohols and 3–10 moles of ethylene oxide), $C_{18}$ linear alkyl monoether of penta- and hexaethylene glycol (Alcohol Ethoxylate AE-18/45™ from Akzo Chemie Corporation), and low alkyl monoethers of polyoxyalkylene glycols prepared from mixtures of alkylene oxides, including Breox™ 27 from ISP Corp. and UCON™ 50-HB-100, -170, and -260 from Union Carbide (1:1 by weight EtO/PrO polymers, started with low alcohols), octyl phenol ethoxylates, using 2–8 moles of EtO (e.g. the Triton™ series from Union Carbide: X-35 (3 EtO), X-45 (5 EtO), X-114 (7–8 EtO) and X-100 (9–10 EtO)), and nonylphenol ethoxylates, using 2–8 moles of ethylene oxide (e.g., Triton™ N-42 (4 EtO), N-57 (5 EtO), N-60 (6 EtO), N-87 (8.5 EtO), N-101 (10 EtO), and corresponding materials from Thompson-Harward Chemical Co., marketed as T-DET™).

Examples of the mixed surfactants (iii) include the full or partial fatty esters of 200–800 molecular weight (number average) polyalkylene glycols, including those of polypropylene and preferably polyethylene glycols. Specific examples include the monolaurate, dilaurate, monooleate, dioleate, monostearate, distearate, monoisostearate, and diisostearate of polyethylene glycol-200, polyethylene glycol-400, polyethylene glycol-600, and ethylene oxide/propylene oxide polyether diols (75:25 weight percent EtO:PrO, UCON™ 75H series). The latter materials preferably have relatively long blocks of ethylene oxide homopolymer.

Type (iv) surfactants include mixed ethers/esters of polyoxyalkylene glycols, including the laurate, oleate, stearate, and isostearate esters of 350 or 750 molecular weight polyethylene glycol monomethyl ether (PEG-350™ or PEG-750™, respectively, from Union Carbide); the laurate, oleate, stearate, and isostearate esters of Triton™ X-45, X-102, N-65, and N-101 (as defined in (ii) above) and of the alkylphenol ethoxylates defined in Type (ii), above; the laurate, oleate, stearate, and isostearate esters of low alkyl monoethers of polypropylene oxide (UCON™ LB-135 or LB-285 from Union Carbide); and the laurate, oleate, stearate, and isostearate esters of low alkyl mono-ethers of ethylene oxide/propylene oxide copolymers (UCON™ 50-HB-75 or 50-HB-100).

Type (v) surfactants include sorbitan and sorbitol partial carboxylic esters, such as sorbitan mono- di- and trioleates, as well as the corresponding stearate and laurate esters, or mixtures thereof; sorbitol mono-, di-, and tri- oleates, as well as the corresponding stearate and laurate esters, or mixtures thereof; glycerol fatty esters, such as glycerol monooleate, glycerol dioleate, the corresponding mono- and di-esters from $C_{10}$–$C_{22}$ acids such as stearic, isostearic, behenic, and lauric acids; corresponding mono- and diesters made from fatty acids and 2-methyl-2-hydroxymethyl-1,3-propanediol, 2-ethyl-2-hydroxymethyl-1,3-propanediol, and tris-hydroxymethyl-methane; the mono-, di-, and triesters from $C_{10}$–$C_{22}$ fatty carboxylic acids and monopentaerythritol; the corresponding partial fatty acid esters of di-pentaerythritol.

Examples of other suitable nonionic surfactants include ethoxylated and polyethoxylated cocoamides and higher amides made from $C_{10}$–$C_{22}$ carboxylic acids such as lauric, oleic, stearic, isostearic and behenic acids; hydroxymethyl-containing 2-alkyl-oxazolines made from $C_{10}$–$C_{22}$ fatty acids and aminopolyols such as 2-amino-1,3-propanediol, 2-amino-2-methyl-1,3-propanediol, 2-amino-2-ethyl-1,3-propanediol, and tris-hydroxymethyl-aminomethane ("THAM"). Additional examples include the $C_9$–$C_{22}$ alkyl or $C_9$–$C_{22}$ alkylpolyoxyalkyl esters of hydroxy-containing carboxylic acids, such as 2-hydroxyacetic acid (glycolic acid) and 2,2-dimethylol acetic acid; hydroxyalkyl esters of 2-alkoxy- and 2-polyoxyalkyloxy-acetic acids, such as the C8–C18-alkoxy[polyoxyethyl]oxyacetic acids sold under the tradename Sandopan™ by Sandoz Corporation, and $C_9$–$C_{18}$ alkyl esters polyether acids such as 3,6,9-trioxadecanoic acid, marketed by Hoechst Chemie. Still other examples of the useful nonionic surfactants include polyoxyethylated castor oil, such as Alkamul™ CO-15 and CO-25 (with 15 and 25 ethylene oxide units, respectively) from Rhone-Poulenc.

The amount of the nonionic surfactant in the composition is an amount sufficient to reduce the viscosity of the composition, compared with the same composition without the surfactant. Under favorable conditions this amount can be as low as 0.01 percent by weight of the composition; preferably the amount will be at least 0.5 percent and more preferably at least 1 percent. The upper limit on the amount of surfactant is not particularly critical; generally it will not exceed that amount above which no further improvement in viscosity is detected. Generally the amount of surfactant will not exceed 10 percent of the composition, preferably 6 percent, and more preferably 4 percent by weight. Otherwise expressed, the hydrogenated diene/aromatic block copolymer and the surface active agent are preferably present in the composition in relative amounts of 2:1 to 6:1 by weight, more preferably 2:1 to 3:1 by weight.

The amount of nonionic surfactant may vary depending on the surfactant chosen as well as on the polymer system to be treated. It is within the skill of a person skilled in the art to determine the appropriate level of treatment, for instance, by preparing one sample without treatment and a second sample containing a proposed amount of the nonionic surfactant. The surfactant, when present in a suitable amount, will provide a measurable reduction in the viscosity of the composition, normally by an amount of at least 10 percent, preferably at least 50%. In preferred circumstances, the composition will be converted from a gel, that is, a composition having a kinematic viscosity in excess of 20,000 cSt at 100° C., commonly well in excess of 20,000 cSt, or even having an immeasurable viscosity due to gelation, to a non-gelled mixture having a kinematic viscosity of less than 20,000, less than 15,000, less than 10,000, or even less than 5000 cSt. When it is found that no or insignificant improvement is obtained, in most cases an adequate improvement can be had by increasing the amount of the surfactant. It may be, however, that in some instances the particular surfactant selected may not provide a measurable improvement for the particular combination of polymer and oil employed, even when the surfactant is present at high concentrations (e.g., above 15% by weight of the composition). Such compositions should be considered to be outside the scope of the present invention, since the surfactant is not present in an amount suitable to reduce the viscosity of the composition. Other materials and additives can be included in the concentrates of the present invention in customary amounts. Such additives include antioxidants, corrosion inhibitors, and extreme pressure and anti-wear agents such as chlorinated aliphatic hydrocarbons, boron-containing compounds including borate esters, and molybdenum compounds. Pour point depressants are also additives which are often included in the lubricating oils described herein. See for example, page 8 of "Lubricant Additives" by C. V. Smalheer and R. Kennedy Smith (Lesius-Hiles Company Publishers, Cleveland, Ohio, 1967). Anti-foam agents can be used to reduce or prevent the formation of stable foam include silicones or organic polymers. Examples of these and additional anti-foam compositions are described in "Foam Control Agents", by Henry T. Kerner (Noyes Data Corporation, 1976), pages 125–162. These and other additives are described in greater detail in U.S. Pat. No. 4,582,618 (column 14, line 52 through column 17, line 16, inclusive).

Although other additives can generally be employed in the compositions of the present invention, the present compositions preferably contain not over 4 percent by weight of one or more ester-containing vinyl polymers, and preferably not over 1 percent by weight of such polymer. Preferably the compositions will be substantially free from such polymer and will preferably will be specifically substantially free from methacrylate polymers. Such polymers may tend to separate from the associated polymers at higher concentrations encountered in a concentrate.

The compositions of the present invention can be prepared by mixing the components using conventional means and apparatus. The mixing order is not particularly critical, although it would normally be preferred to mix the components in oil rather than combining the neat additives, then adding oil.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. The term includes hydrocarbon, as well as substantially hydrocarbon groups. Substantially hydrocarbon describes groups which contain non-hydrocarbon substituents which do not alter the predominately hydrocarbon nature of the group.

Examples of hydrocarbyl groups include the following:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents as well as cyclic substituents wherein the ring is completed through another portion of the molecule (e.g., two indicated substituents may together form an alicyclic radical);

(2) substituted hydrocarbon substituents, that is, those containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);

(3) hetero substituents, that is, substituents which, while having a predominantly hydrocarbon character within the context of this invention, contain other than carbon in a ring or chain otherwise composed of carbon atoms. Suitable heteroatoms include sulfur, oxygen, nitrogen, and such substituents as, pyridyl, furyl, thienyl, and imidazolyl. In general, no more than 2, preferably no more than one, non-hydrocarbon substituent will be present for every ten carbon atoms in the hydrocarbyl group. Typically, there will be no non-hydrocarbon substituents in the hydrocarbyl group.

EXAMPLES

Examples 1–21

A solution is prepared of 6 weight percent hydrogenated styrene/isoprene diblock copolymer (Shellvis 40™) in 100N oil. Samples of various nonionic surfactants, or, for comparison, diluent oil are added to samples by mechanical blending (stainless blade, 80° C., 400 r.p.m.); the kinematic viscosity at 100° C. of each composition is measured by the method of ASTM D 445, at 100° C. The results, in cSt, are shown in Table I.

TABLE I

| Ex. | Surfactant, type | % | Viscosity |
|---|---|---|---|
| 1 | None | 0 | Gel |
| 2 | None (3% diluent oil added) | 3 | Gel |
| 3 | Polyethylene glycol "PEG" (400 mw) monolaurate | 3 | 14,700 |
| 4 | PEG (400) dilaurate | 3 | 4,290 |
| 5 | PEG (400) monostearate | 3 | Gel |
| 6 | $C_{12-15}$ branched alcohol (Neodol 25 ™) | 3 | Gel |
| | $C_{12-18}$ near alcohol (Alfol 1218 ™) | 3 | 2,530 |
| 8 | $C_{15-18}$ alkyl 1,2-vicinal diol (Adol 158 ™) | 3 | 3,500 |
| 9 | PEG (300) α, ω diol | 3 | 24,200 |
| | Alkoxylated[a] alcohols: | | |
| 10 | $C_{12-15}$ alkyl$(EtO)_7H$ (Neodol 25-7 ™) | 3 | 14,200 |
| 11 | Octadecanol$(EtO)_7H$ (Ethomeen 18/60 ™) | 3 | 7,114 |
| 12 | Cocoamide$(EtO)_5H$ (Unamide C-5 ™) | 3 | 3,040 |
| 13 | Castor oil$(EtO)_{15}H$ (Alkamus CO-15 ™) | 3 | Gel |
| 14 | BuO-(propoxypropyl)OH (640 mw) (UCON LB-135 ™) | 3 | 3,614 |
| | Alkoxylated phenols: | | |
| 15 | Octylphenol$(EtO)_6H$ (Triton X-45 ™) | 3 | Gel |
| 16 | Nonylphenol$(BtO)_5H$ (Triton N-42 ™) | 3 | 4,650 |
| 17 | Nonylphenol$(EtO)_7H$ (Triton N-60 ™) | 3 | 4,150 |
| | Mixed polyether derivatives: | | |

TABLE I-continued

| Ex. | Surfactant, type | % | Viscosity |
|---|---|---|---|
| 18 | Poly(EtO-block-PrO)dioleate (Kessco 894 ™) | 3 | Gel |
| 19 | Poly(EtO-block-PrO)monooleate (Kessco 891 ™) | 3 | Gel |
| 20 | Glycerol monooleate, 60% (+ 40% dioleate) | 3 | 4,429 |
| 21 | Glycerol trimer monooleate (Drewpol 3-1-0 ™) | 3 | Gel |

[a]: Et = Ethyl, Pr = Propyl, Bu = Butyl

Examples 22–41

The procedure of Examples 1–21 is repeated, except that the reference polymer solution is 10% hydrogenated styrene/butadiene random tapered block copolymer (from BASF) in 100N oil. The results are shown in Table II.

TABLE II

| Ex. | Surfactant, type | % | Viscosity |
|---|---|---|---|
| 22 | None | 0 | Gel |
| 23 | None (3% diluent oil added) | 3 | Gel |
| 24 | PEG (400 ) monolaurate | 1.5 | 8,740 |
| 25 | PEG (400 ) monolaurate | 3.0 | 7,416 |
| 26 | PEG (400 ) monolaurate | 4.0 | 6,420 |
| 27 | PEG (400) dilaurate | 1.5 | 7,071 |
| 28 | PEG (400) dilaurate | 3.0 | 5,635 |
| 29 | PEG (400) dilaurate | 4.0 | 4,050 |
| 30 | PEG (400) monostearate | 3.0 | 5,075 |
| 31 | $C_{12-15}$ branched alcohol (Neodol 25 ™) | 3.0 | 2,640 |
| 32 | $C_{12-18}$ linear alcohol (Alfol 1218 ™) | 3.0 | 4,316 |
| 33 | $C_{15-18}$ alkyl 1,2-vicinal diol (Adol 158 ™) | 3.0 | 3,978 |
| 34 | PEG (300) α, ω-diol | 3.0 | Gel |
| | Alkoxylated alcohols: | | |
| 35 | $C_{12-18}$ alkyl$(EtO)_7H$ (Neodol 25-7 ™) | 3.0 | 3,792 |
| 36 | Cocoamide$(EtO)_5H$ (Unamide C-5 ™) | 3.0 | Gel |
| 37 | Castor oil$(EtO)_{15}H$ (Alkamus CO-15 ™) | 3.0 | Gel |
| 38 | BuO-(propoxypropyl)OH (640 mw) (UCON LB-135 ™) | 3.0 | 5,836 |
| | Alkoxylated phenols: | | |
| 39 | Nonylphenol$(EtO)_5H$ (Triton N-42 ™) | 3.0 | 3,230 |
| 40 | Nonylphenol$(EtO)_7H$ (Triton N-60 ™) | 3.0 | 3,925 |
| 41 | Glycerol monooleate, 60% (+ 40% dioleate) | 3.0 | 4,914 |

It is accepted that some of the materials described above may interact in the final formulation, so that the components of the final formulation may be different from those that are initially added. As an example, metal ions of one molecule can migrate to acidic sites of other molecules. The products formed by such interactions, including the products formed upon employing the composition of the present invention in its intended use, may not succeptible of easy description. Nevertheless, all such modifications and reaction products are included within the scope of the present invention; the present invention encompasses the composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. As used herein, the expression "consisting essentially of" permits the inclusion of substances which do not materially affect the basic and novel characteristics of the composition under consideration.

What is claimed is:

1. A composition comprising:

(a) about 2 to about 20 percent by weight of a block copolymer comprising a vinyl aromatic comonomer moiety and second comonomer moiety;

(b) an oil of lubricating viscosity; and (c) a non-ionic surface active agent, soluble in said oil, comprising at least one ester or ether group, in an amount sufficient to reduce the viscosity of the composition of said block copolymer in said oil;

wherein the total amount of polymer species in the composition, exclusive of the non-ionic surface active agent, is less than 30 percent by weight.

2. The composition of claim 1 wherein the oil is mineral oil.

3. The composition of claim 1 wherein the oil is a poly-α-olefin synthetic oil.

4. The composition of claim 1 wherein the block copolymer is a hydrogenated diene/vinyl aromatic block copolymer.

5. The composition of claim 4 wherein the hydrogenated diene/vinyl aromatic block copolymer is soluble in the oil of lubricating viscosity.

6. The composition of claim 4 wherein the hydrogenated diene/vinyl aromatic block copolymer is a styrene/butadiene diblock copolymer.

7. The composition of claim 1 wherein the polymer comprises about 4 to about 18 percent by weight of the composition.

8. The composition of claim 1 wherein the polymer comprises about 6 to about 12 percent by weight of the composition.

9. The composition of claim 1 wherein the nonionic surfactant is selected from the group consisting of (i) alkylene diols or polyoxyalkylene diols;

(ii) alkyl or aryl mono- and bis-ethers of polyoxyalkylene diols, where the oxyalkylene group has at least two carbon atoms and the alkyl or aryl groups have at least nine carbon atoms;

(iii) partial or full alkanoate esters of polyoxyalkylene diols, where the repeating oxyalkylene group has at least two carbon atoms and the alkanoate group has at least nine carbon atoms;

(iv) mixed ether/ester-terminated polyoxyalkylene polymers, where the repeating oxyalkylene group has at least two carbon atoms and the alkanoate group has at least nine carbon atoms; and (v) partial alkanoate esters of hydrocarbylene polyols, where the hydrocarbylene group has at least three carbon atoms and the alkanoate group has at least nine carbon atoms.

10. The composition of claim 1 wherein the nonionic surfactant is a partial or full alkanoate ester of poly (oxyethylene) diol, the alkanoate group having at least 9 carbon atoms and the surfactant having a number average molecular weight of about 200 to about 600.

11. The composition of claim 1 wherein the surfactant comprises glycerol monooleate.

12. The composition of claim 11 wherein the surfactant comprises a mixture of glycerol monooleate and glycerol dioleate.

13. The composition of claim 1 wherein the amount of the surfactant is about 0.01 to about 20 percent by weight.

14. The composition of claim 1 wherein the amount of the surfactant is about 0.5 to about 10 percent by weight.

15. The composition of claim 1 wherein the amount of the surfactant is about 1 to about 4 percent by weight.

16. The composition of claim 1 containing 0 to about 4 percent by weight ester-containing vinyl polymer.

17. The composition of claim 1 containing 0 to about 1 percent by weight ester-containing vinyl polymer.

18. The composition of claim 1 being substantially free from ester-containing vinyl polymer.

19. The composition of claim 1 being substantially free from methacrylate polymer.

20. A process for reducing the viscosity of a composition comprising an oil of lubricating viscosity and about 2 to about 20 percent by weight of the composition of a block copolymer comprising a vinyl aromatic comonomer moiety and second comonomer moiety, comprising the steps of:

(a) selecting a non-ionic surface active agent, soluble in oil, comprising at least one ester or ether group; and (b) combining the non-ionic surface active agent with the oil and the polymer, in an amount sufficient to reduce the viscosity of said composition of polymer in oil.

21. The process of claim 20 wherein the oil is mineral oil or a poly-α-olefin.

22. The process of claim 20 wherein the block copolymer is a hydrogenated diene/vinyl aromatic block copolymer.

23. The process of claim 20 wherein the nonionic surfactant is selected from the group consisting of (i) alkylene diols or polyoxyalkylene diols;

(ii) alkyl or aryl mono- and bis-ethers of polyoxyalkylene diols, where the oxyalkylene group has at least two carbon atoms and the alkyl or aryl groups have at least nine carbon atoms;

(iii) partial or full alkanoate esters of polyoxyalkylene diols, where the repeating oxyalkylene group has at least two carbon atoms and the alkanoate group has at least nine carbon atoms;

(iv) mixed ether/ester-terminated polyoxyalkylene polymers, where the repeating oxyalkylene group has at least two carbon atoms and the alkanoate group has at least nine carbon atoms; and (v) partial alkanoate esters of hydrocarbylene polyols, where the hydrocarbylene group has at least three carbon atoms and the alkanoate group has at least nine carbon atoms.

24. The process of claim 20 wherein the nonionic surfactant is a partial or full alkanoate ester of poly(oxyethylene) diol, the alkanoate group having at least 9 carbon atoms and the surfactant having a number average molecular weight of about 200 to about 600.

* * * * *